US005482185A

United States Patent [19]

McNaughton

[11] Patent Number: 5,482,185

[45] Date of Patent: Jan. 9, 1996

[54] APPARATUS FOR CATCHING CONTAINERS DISPENSED FROM A CONTAINER STORAGE UNIT

[75] Inventor: Patrick J. McNaughton, Minneapolis, Minn.

[73] Assignee: McNaughton, Inc., Minneapolis, Minn.

[21] Appl. No.: 182,640

[22] Filed: Jan. 14, 1994

[51] Int. Cl.[6] ..... A47F 1/04

[52] U.S. Cl. ..... 221/303; 206/44.12; 206/427; 229/122.1

[58] Field of Search ..... 221/303, 305, 221/311, 312 R, 31 CC; 312/45, 49, 72, 73; 206/44.12, 427, 428, 429; 229/122, 122.1, 19

[56] References Cited

U.S. PATENT DOCUMENTS

| | | | |
|---|---|---|---|
| 1,753,957 | 4/1930 | Washburn | 221/311 |
| 2,826,471 | 3/1958 | Fonda | 221/311 |
| 3,012,704 | 12/1961 | Stumpf | 206/44.12 |
| 3,263,861 | 8/1966 | Carr | 221/305 |
| 3,265,246 | 8/1966 | Messenger | 221/311 |
| 3,706,397 | 12/1972 | Zeilinger | 221/311 |
| 4,364,509 | 12/1982 | Holley et al. | 221/305 |
| 4,435,026 | 3/1984 | Johnson | 312/45 |
| 4,801,045 | 1/1989 | Barnhart | 221/305 |
| 4,899,929 | 2/1990 | Grollman | 221/305 |
| 5,284,292 | 2/1994 | Johnson | 229/122.1 |

*Primary Examiner*—H. Grant Skaggs
*Attorney, Agent, or Firm*—Kinney & Lange

[57] ABSTRACT

An apparatus for catching containers dispensed from an opening of a storage unit having a plurality of such containers therein for the transport and storage of the containers therein. The storage unit is positionable such that each of the plurality of containers exits the storage unit one at time through the opening. The apparatus comprises a base member and a stop member. The base member is positionable adjacent a lower edge of the storage unit and extends outward from the lower edge of the storage unit such that a discharge station is defined adjacent to the opening for receiving and dispensing each of the plurality of containers. The stop member is attached to the base member for retaining each of the plurality of containers in the discharge station such that the plurality of containers remaining within the storage unit are retained therein. When one of the containers is removed from the discharge station one of the plurality of containers remaining in the storage unit is forced into the discharge station and retained thereon by the stop member.

19 Claims, 8 Drawing Sheets

APPARATUS FOR CATCHING CONTAINERS DISPENSED FROM A CONTAINER STORAGE UNIT

BACKGROUND OF THE INVENTION

The present invention relates generally to an apparatus for organizing and distributing a plurality of containers in a storage unit used for storing and transporting the plurality of containers therein. More particularly, the present invention relates to an apparatus for catching and holding containers, such as food or beverage cans, which are dispensed from an opening in the storage unit.

Many products, and in particular canned beverages, are packaged in cylindrical aluminum containers and distributed in master cardboard cartons which hold either 12, 18, 20, 24 or 30 individual cans. Consumers of these products typically store these master cartons in refrigerators, prior to the consumption of the beverage, so that the contents are cold and more desirable to consume.

The master cardboard cartons include a perforated panel which, when removed by the consumer, forms an opening for dispensing the containers within the master carton. The opening is positioned on the carton such that the canned beverages in a lower section of the master carton may roll out through the opening under the force of gravity acting on the containers in an upper section of the master carton when the master carton is positioned in a refrigerator, closet or other storage location. However, the weight of the cans causes a force which is typically so strong that several cans are forced out of the opening at one time. The inability to control the flow or distribution of the cans through the opening is undesirable.

In response to the public's behavior of storing and consuming these foods and beverages several attempts have been made for organizing and distributing the canned foods and beverages. In one device a plastic rack or a plastic coated metal rack is placed on a flat surface and the original master container is unloaded and the cans placed sequentially one in front of the other into this rack device. The original cardboard container is then discarded and the rack device is used in its place. The cans roll sequentially to a front or end position where they are accessible for removal from the rack device. Another such device consists of modular stacking trays as illustrated in U.S. Pat. No. 4,435,026. The modular stacking trays consist of a series of modular ramps stacked on top of one another. The stacking trays are loaded from the top and the force of gravity encourages the cans to roll down a series of descending ramps to a discharge station.

The problem with all of these units is that they are separate from the original master container and require the user to perform the time consuming task of unloading the original container and loading the new device. Additionally, there are substantial expenses involved in providing a device of the dimensions required to store an entire master carton of food or beverage containers.

SUMMARY OF THE INVENTION

The present invention relates to an apparatus for catching containers dispensed from an opening of a storage unit having a plurality of the containers therein for the transport and storage of the containers therein. The storage unit is positionable such that each of the plurality of containers exits the storage unit one at time through the opening. The apparatus comprises a base member and a stop member. The base member is positionable adjacent a lower edge of the storage unit and extends outward from the lower edge of the storage unit such that a discharge station is defined adjacent the opening for receiving and dispensing each of the plurality of containers one at a time. The stop member is attached to the base member for retaining each of the plurality of containers in the discharge station such that the plurality of containers remaining within the storage unit are retained therein. When one of the containers is removed from the discharge station one of the plurality of containers remaining in the storage unit is forced into the discharge station and retained thereon by the stop member.

In the illustrated embodiments the apparatus is used for catching aluminum beverage cans. However, it is to be understood that the present invention has application to any type of container and any type of storage unit which is used to pack, ship and store a plurality of such containers and which dispenses the containers from the storage unit one at a time.

DETAILED DESCRIPTION OF THE PREFERRED EMBODIMENTS

Figure 1:
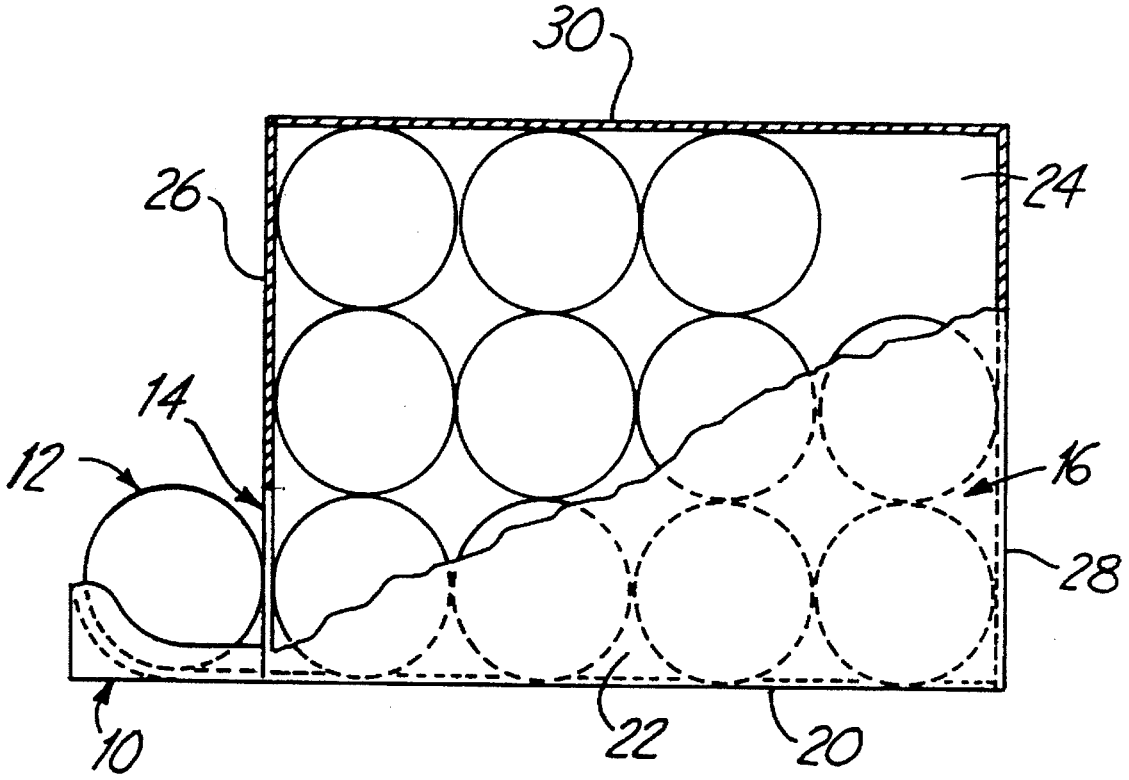
FIG. 1 is a side elevational view of an apparatus for catching containers in use with a storage unit having a plurality of such containers therein, according to the present invention.

FIG. 1 shows a container catching apparatus 10 for catching containers 12 which, in the present example, may be food or beverage cans dispensed from an opening 14 of a portable storage unit 16 used for packing, shipping and storing a plurality of such containers 12 therein. Although the present invention will be described with reference to food or beverages cans contained with a cardboard storage unit, it should be understood that the present invention may be used in a variety of applications with a number of other containers 12 such as for example, lipstick containers, paint cans, aerosol sprays, etc and with a variety of other storage units 16 which may be composed of for example plastic, wood or metal.

Figure 4:
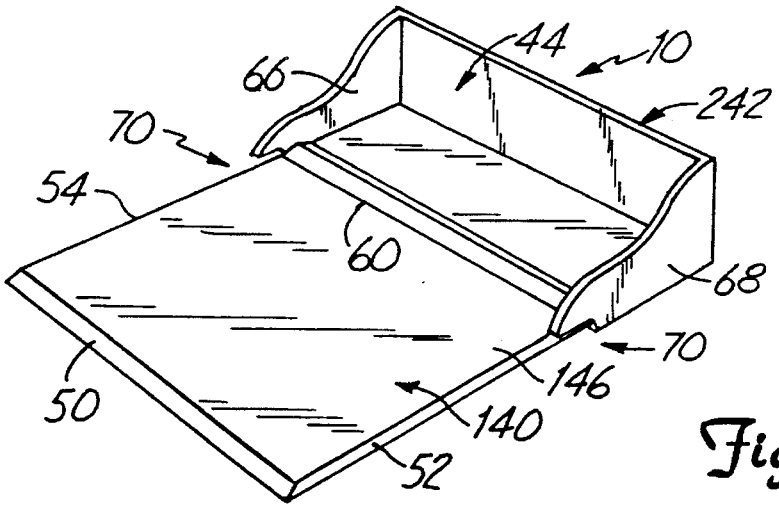
FIG. 4 is a perspective view of the apparatus of FIG. 1 showing another embodiment of the stop member.

Referring to FIGS. 1 and 4 the storage unit 16 has a bottom wall 20, a first side wall 22, a second side wall 24, a front wall 26, a back wall 28 and a top wall 30. The container catching apparatus 10 operates with the dispensing opening 14 which is located on the front wall 26 adjacent the bottom wall 20 of the storage unit 16. The storage unit 16 is positioned such that the bottom wall 20 is adjacent a surface, such as a shelf in a refrigerator or in a closet. As shown in FIG. 1 the containers 12 are cylindrical and positioned in the storage unit 16 such that an cylindrical edge of the containers 12 is tangential to other containers and to the front wall, back wall, top wall and bottom wall of the storage unit 16 such that the containers 12 can roll on top of one another. The storage unit 16 is positioned such that the weight of the containers 12 in an upper region of the storage unit 16 act upon the containers in a lower region of the storage unit 16 to cause the container closest to the dispensing opening 14 to be expelled therefrom.

The container catching apparatus 10 includes a base member 40 and a stop member 42 and communicates with the dispensing opening 14 to catch and retain containers 12 as they are dispensed from the storage unit 16 through the opening 14. The base member 40 is positionable adjacent the bottom wall 20 of the storage unit 16 and adjacent the dispensing opening 14 such that a discharge station 44 is formed for receiving and dispensing each of the plurality of the containers 12 as they exit the dispensing opening 14. In the illustrated embodiments the discharge station 44 has a dimension sufficient to store one of the containers 12 outside of the storage unit 16. However, it should be understood that the size of the discharge station 44 may be varied such that multiple containers 12 are available outside of the storage unit 16.

Figure 2:
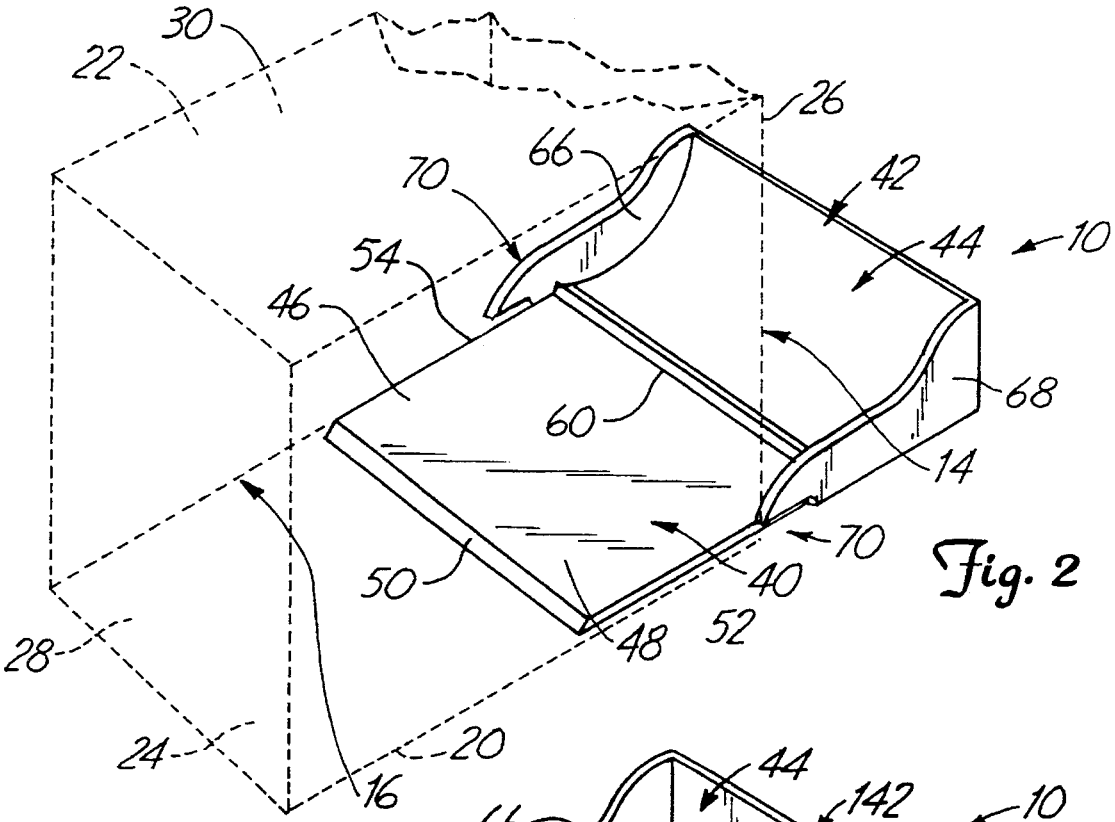
FIG. 2 is a perspective view of an apparatus for catching containers dispensed from a storage unit according to the present invention.

As shown in FIG. 2 the base member 40 is an elongated rectangular section made from plastic, wood, metal or other substance and having a top surface 46, a bottom surface 48, a leading edge 50 and side walls 52 and 54. The leading edge 50 of base member 40 is beveled so as to permit the containers 12 to easily roll up onto the base member 40 and into the discharge station 44. The precise angle of the bevel may be varied depending on the size of the containers 12 and to suit particular design considerations. The base member 40 has a width dimension sufficient to receive a container 12 passing through the opening 14 of the storage unit 16. The base member 40 has a length dimension sufficient for the container catching apparatus 10 to engage the storage unit 16 either below the bottom wall 20 or on top of the bottom wall 20 for alignment purposes and for leverage purposes if the storage unit 16 is tipped forward to dispense the last few containers 12 into the discharge station 44. In either construction the weight of the containers 12 within the storage unit 16 acts on the base member 40 of the container catching apparatus 10 to maintain the container catching apparatus 10 in its desired position adjacent the dispensing opening 14.

A retaining ridge 60 protrudes upward from the base member 40 at a leading edge of the discharge station 44 for preventing a container 12 in the discharge station 44 from rolling back into the storage unit 16. The retaining ridge 60 may be integrally molded or formed into the base member 40 or may be a separate member attached to the base member 40 by conventional means such as glue or nails.

The stop member 42 is attached to the base member 40 for retaining each of the plurality of containers 12 at a trailing edge of the discharge station 44 one at a time such that the plurality of containers 12 remaining within the storage unit 16 are retained therein. When one of the containers 12 is removed from the discharge station 44 one of the plurality of containers 12 remaining in the storage unit 16 is forced into the discharge station 44 by a gravitational force and retained thereon by the stop member 42.

Referring to FIG. 2 the stop member 42 is integrally formed with the base member 40 and is curved upward approximately 90° such that it extends from the base member 40 to a position substantially perpendicular to the base member 40. The curved section of the stop member 42 has a radius approximately equal to that of the container 12 so as to provide an adequate fit of the container 12 in the discharge station 44.

A pair of opposed guide walls 66 and 68 are attached to the side walls 52 and 54, respectively. The guide walls 66 and 68 extend through the discharge station 44 from the base member 40 to the stop member 42 for guiding containers 12 from the dispensing opening 14 into the discharge station 44 and for preventing lateral movement of containers 12 in the discharge station 44.

The container catching apparatus 10 further comprises an engaging member 70 for engaging the container catching apparatus 10 to the storage unit 16. The engaging member 70 is preferable to provide a physical engagement of the container catching apparatus 10 to some portion of the storage unit 16. Still referring to FIG. 2, the engaging member 70 is a portion of a guide walls 66 and 68 spaced apart from the base member 40 slightly upstream of the leading edge of the discharge station 44. When the base member 40 is inserted into the dispensing opening 14 the first and second side walls 22 and 24 of the storage unit 16 are engaged between the periphery of the base member 40 and the spaced apart portion of the guide walls 66 and 68. More particularly, the side walls 22 and 24 of the storage unit 16 are flexed either inward or outward to fit into the gap between the guide walls 66 and 68 and the base member 40. The side walls 22 and 24 are constructed such that they have a tendency to flex back to their original position. The flexion of side walls 22 and 24 applies either an inward or outward force on the guide walls 66 and 68 to thereby secure the container catching apparatus 10 to the storage unit 16 adjacent to the dispensing opening 14.

With reference to the embodiments shown in FIGS. 2–13, the elements therein which are structurally and functionally like the elements shown in FIG. 2, will be referenced using like reference numbers. The elements shown in FIGS. 3–14 which are structurally and/or functionally different from the elements shown in FIG. 2, will be referenced using the reference numeral of FIG. 2 increased by 100, 200, 300, etc. for each distinct embodiment. Similarly, elements which are shown in FIGS. 3–14 which are not shown in FIG. 2 will be referenced with an odd reference number.

Figure 3:
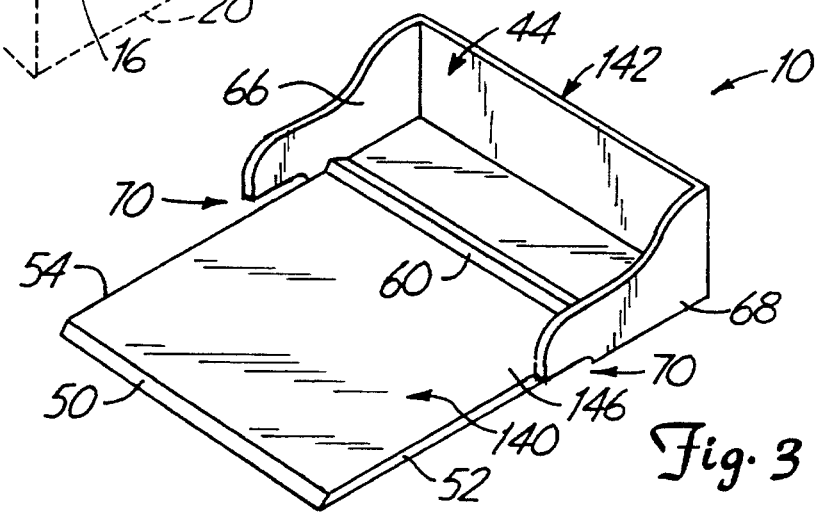
FIG. 3 is a perspective view of the apparatus of FIG. 1 showing another embodiment of the stop member.

Referring to FIG. 3 the stop member 142 is a planar member extending substantially perpendicular to the base member 140.

Referring to FIG. 4 the stop member 242 is an elongated rod or similar member mounted between the guide walls 66 and 68 and spaced apart from the top surface 146 of the base member 140.

Figure 5:
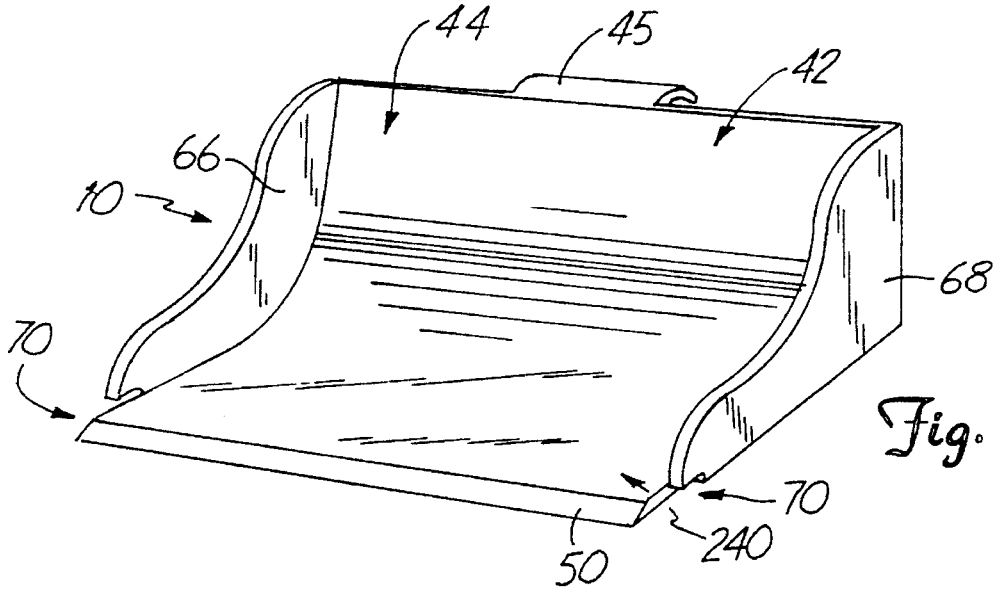
FIG. 5 is a perspective view of the apparatus of FIG. 1 showing another embodiment of the base member.

Referring to FIG. 5, the base member 240 is substantially shorter than the base member shown in FIG. 1–3. The leading edge 50 of the base member 240 is beveled to permit the containers 12 to roll up into the discharge station 44. A handle 45 is provided for maneuvering the container catching apparatus 10 into and out of communication with the storage unit 16.

Figure 6:
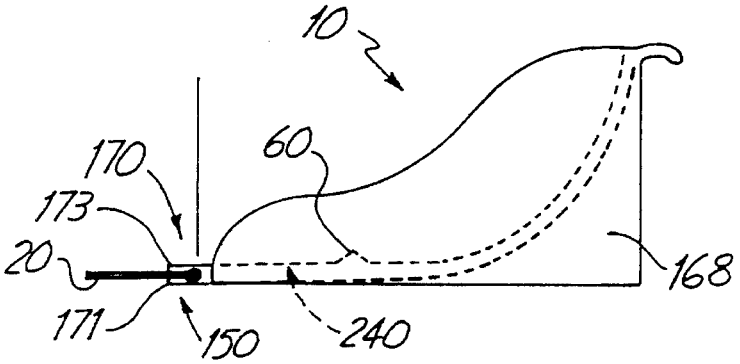
FIG. 6 is a side elevational view of the apparatus of FIG. 4 showing another embodiment of the engaging member.

Referring to FIG. 6 the engaging member 170 is a pinch point area along a leading edge 150 of the base member 240 for engaging the bottom wall 20 of the storage unit 16 adjacent the dispensing opening 14. The engaging member 170 includes a lower pinch point 171 running along the leading edge 50 of the base member 240, an upper pinch point 173 extending parallel to the lower pinch point 171 and spaced apart from the lower pinch point 171 for insertion there between of an edge of the bottom wall 20 of the storage unit 16. The upper and lower pinch points 171 and 173 are biased towards each other so as to provide a sufficient force on the bottom wall 20 to maintain the container catching apparatus 10 in communication with the storage unit 16. The guide walls 166 and 168 guide the containers 12 from the dispensing opening 14 into the discharge station 44 and prevent lateral movement of the containers 12 when in the discharge station 44.

Figure 7:
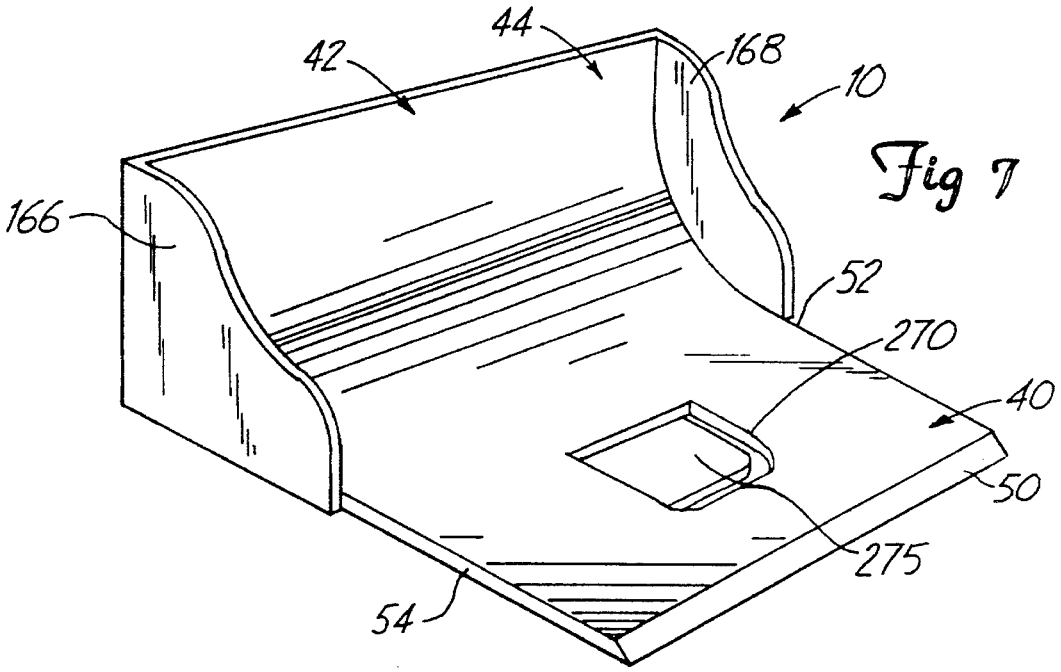
FIG. 7 is a perspective view of the apparatus of FIG. 1 showing another embodiment of the engaging member.

Referring to FIG. 7 the engaging member 270 includes a tab 275 protruding from the bottom surface 48 of the base member 40 and extending substantially parallel to the bottom surface 48 of the base member 40 in a direction opposite of the stop member 42. The bottom wall 20 of the storage unit 16 is engaged between the bottom surface 48 of the base member 40 and the tab 275. In this embodiment the base member 40 is positioned inside of the storage unit 16 and the tab 275 remains outside of the storage unit 16.

Figure 8:
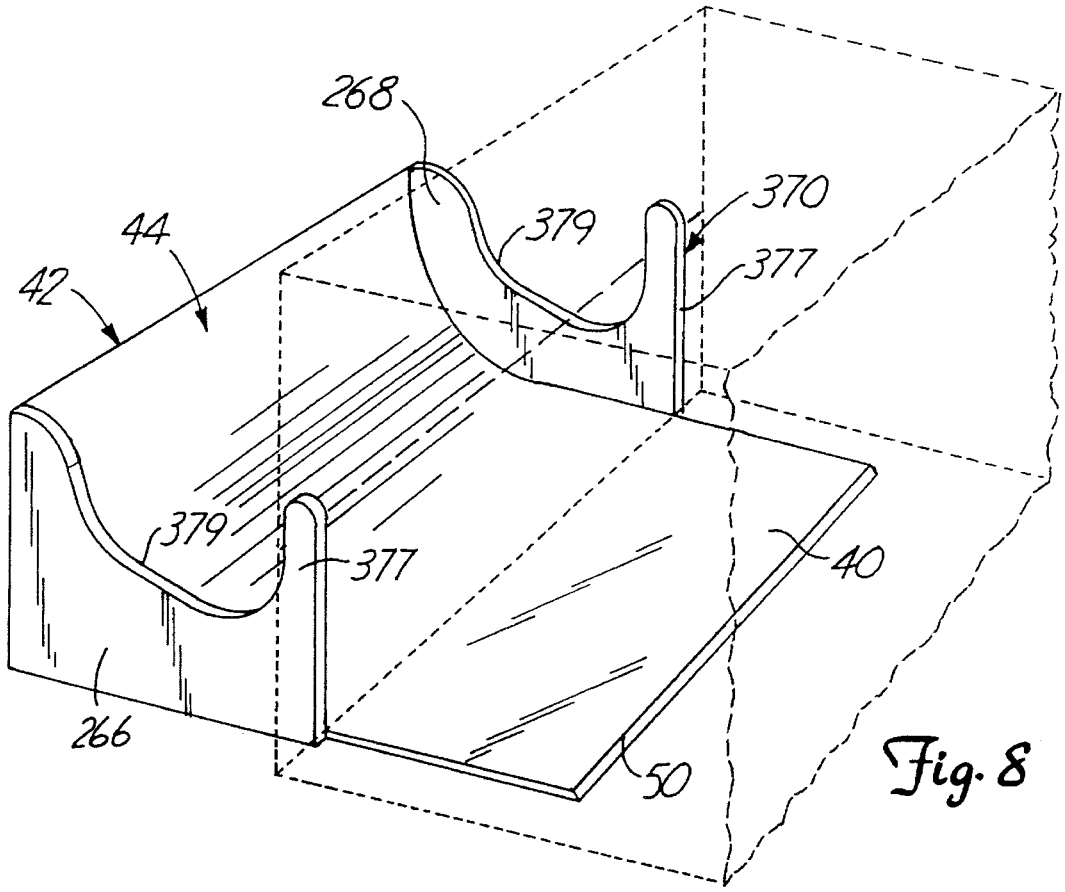
FIG. 8 is a perspective view of the apparatus of FIG. 1 showing another embodiment of the engaging member.

Referring to FIG. 8 the engaging member 370 includes a pair of hook members 377 each extending upward from a periphery of the base member 40. More particularly, the hook members 377 are integrally molded into of the guide walls 266 and 268. The hook members 377 form a leading edge of the guide walls 266 and 268 and a recess 379 is provided in each of the guide walls 266 and 268 for receiving the front wall 26 of the storage unit 16. The hook members 377 have a height sufficient such that each hook member 377 can be maneuvered through the dispensing opening 14 to insert the container catching apparatus 10 within the storage unit 16, but such that each hook member 377 engages the front wall 26 so as to retain the container catching apparatus 10 within the storage unit 16 as the plurality of containers 12 are fed into the discharge station 44.

Figure 9:
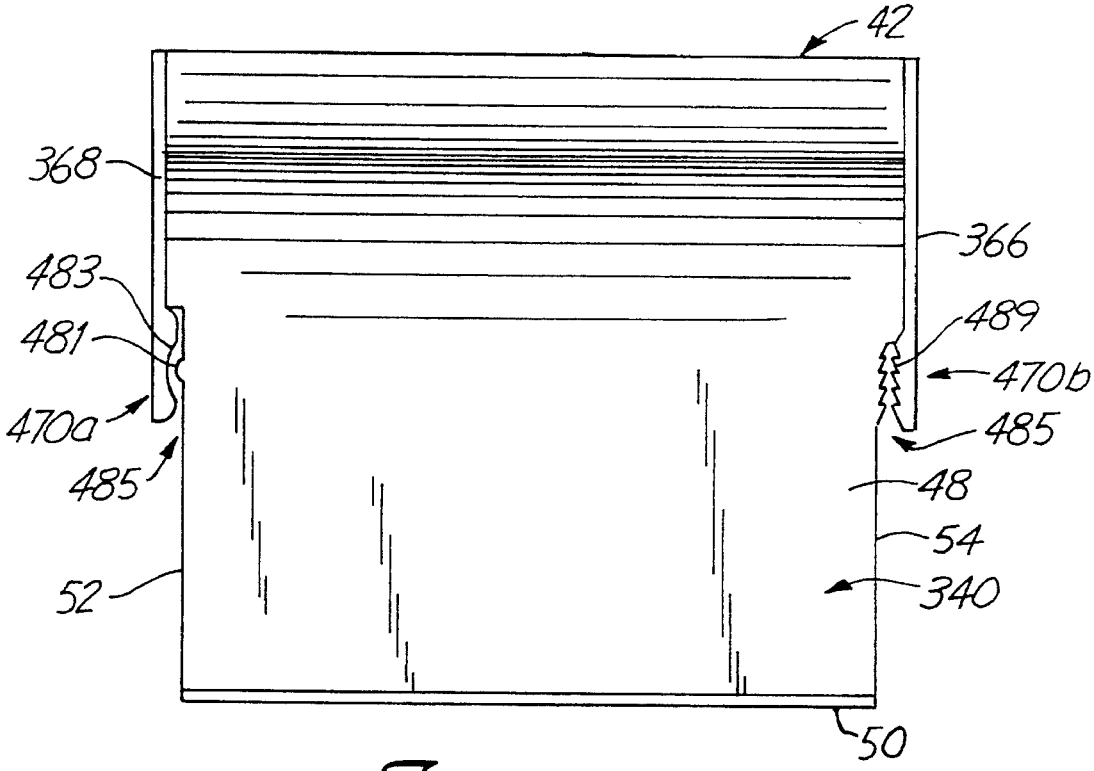
FIG. 9 is a top plan view of the apparatus of FIG. 1 showing two additional embodiments of the engaging member.

FIG. 9 shows engaging members **470*a* and 470*b* formed at a leading edge of the guide walls 366 and 368. Engaging member 470*a* includes an engaging pin 481 protruding from the side wall 52 of the base member 340 into a corresponding recess 485 on the guide wall 368 so as to form a gap 485 for receiving the side wall 22 of the storage unit 16. The side wall 22 of the storage unit 16 is deformed within the gap 485 and is secured to the container catching apparatus 10. The engaging member 470*b* includes serrated teeth 489 which securely grip the side wall 24 of the storage unit 16. The serrated teeth 489 are angled such that the side wall 24 may be received into a gap 485 formed between the guide wall 366 and the side wall 54 of the base member 340**.

Figure 10:
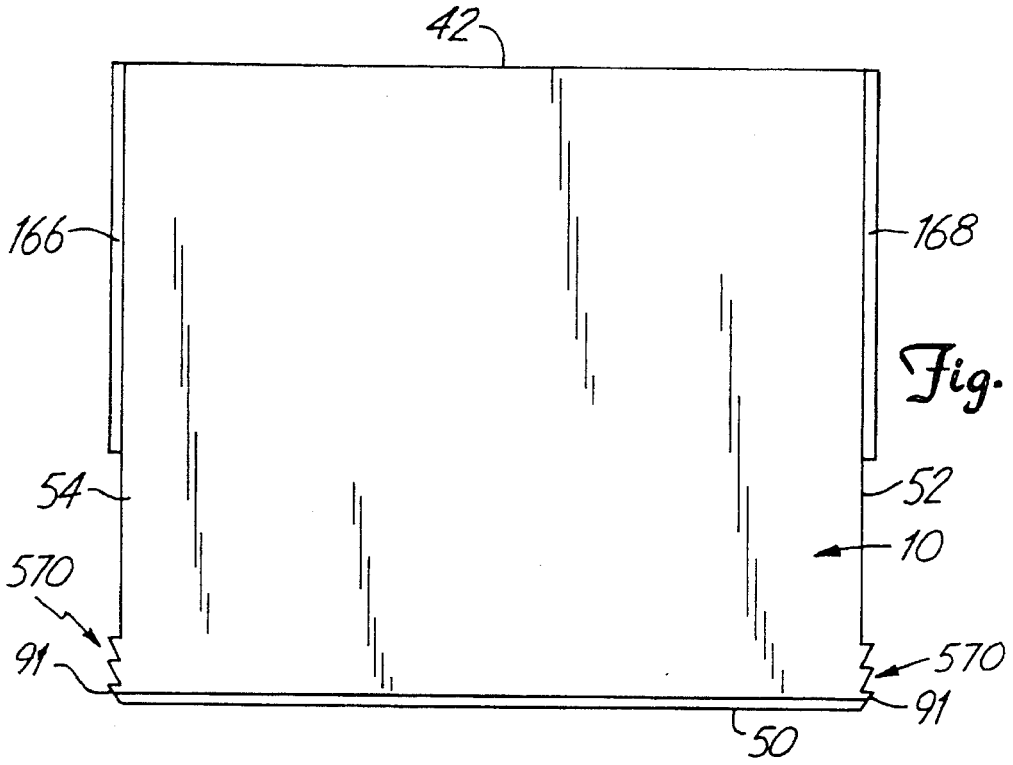
FIG. 10 is a top plan view of the apparatus of FIG. 1 showing another embodiment of the engaging member.

Referring to FIG. 10 the engaging member 570 includes serrated teeth 91 positioned on the side walls 52 and 54 of the base member 40 adjacent the leading edge 50 thereof. The serrated teeth 91 engage the side walls 22 and 24 of the storage unit 16 when the base member 40 is inserted into the dispensing opening 14 of the storage unit 16.

Figure 11:
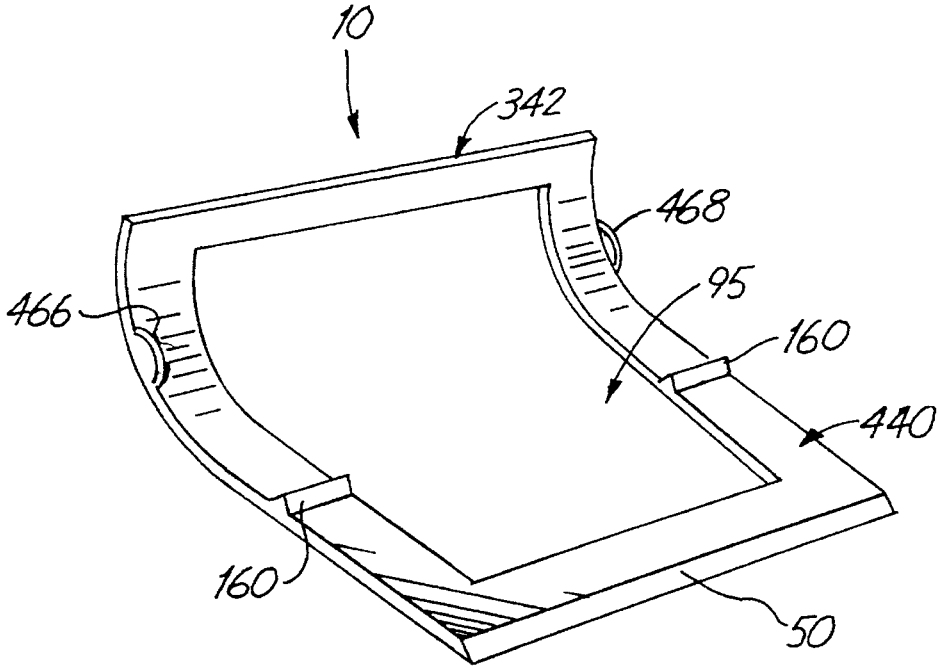
FIG. 11 is a perspective view of another embodiment of the apparatus for catching containers dispensed from a storage unit according to the present invention.

Referring to FIG. 11 the base member 440 and the stop member 342 include a central opening 95 which eliminates material from the container catching apparatus 10. The base member 440 and stop member 342 are integrally molded together similar to the embodiment shown in FIG. 1, except with the central opening 95. In addition the guide walls 466 and 468 have been reduced to small protrusions which function to prevent lateral movement of the containers 12 in the discharge station 44.

Figure 12:
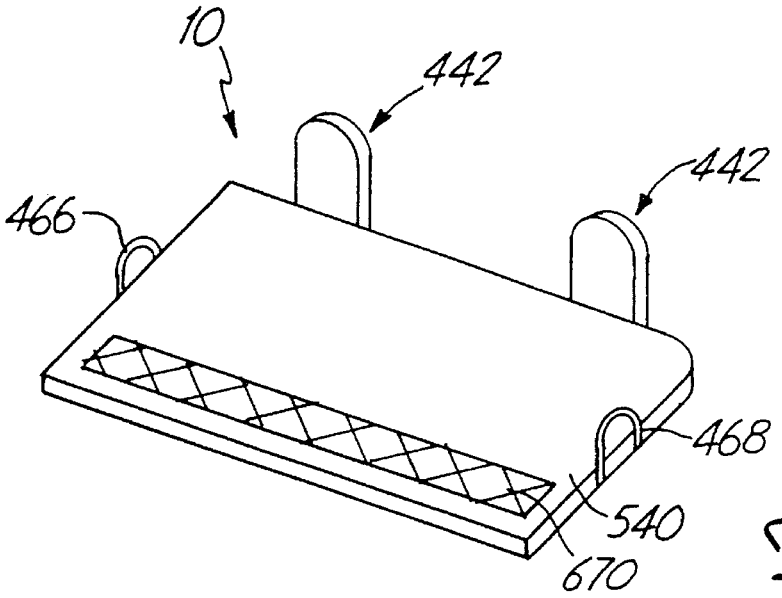
FIG. 12 is a perspective view of another embodiment of the apparatus for catching containers dispensed from a storage unit according to the present invention.

Referring to FIG. 12 the base member 540 is a planar section and the stop member 442 includes a pair of protrusions extending upward substantially perpendicular to the base member 540. The protrusions have a height sufficient to retain a container within the discharge station. The engaging member 670 is an adhesive on the top surface 46 of the base member 540 for engaging the base member 546 underneath the bottom wall 20 of the storage unit 16. The adhesive may be placed on the bottom surface 48 of the base member 540 for engaging the base member 540 to the bottom wall 20 of the storage unit 16.

Figure 13:
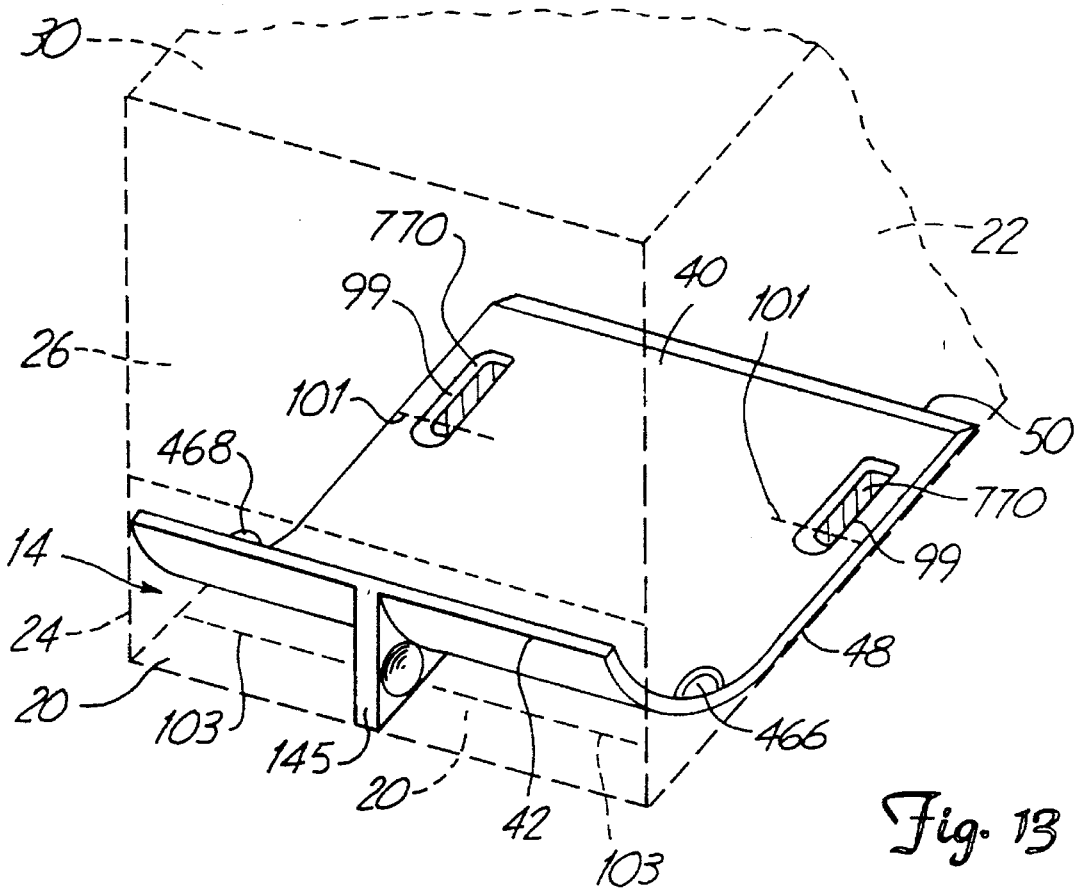
FIG. 13 is a perspective view of another embodiment of the apparatus for catching containers dispensed from a storage unit according to the present invention.
Figure 14:
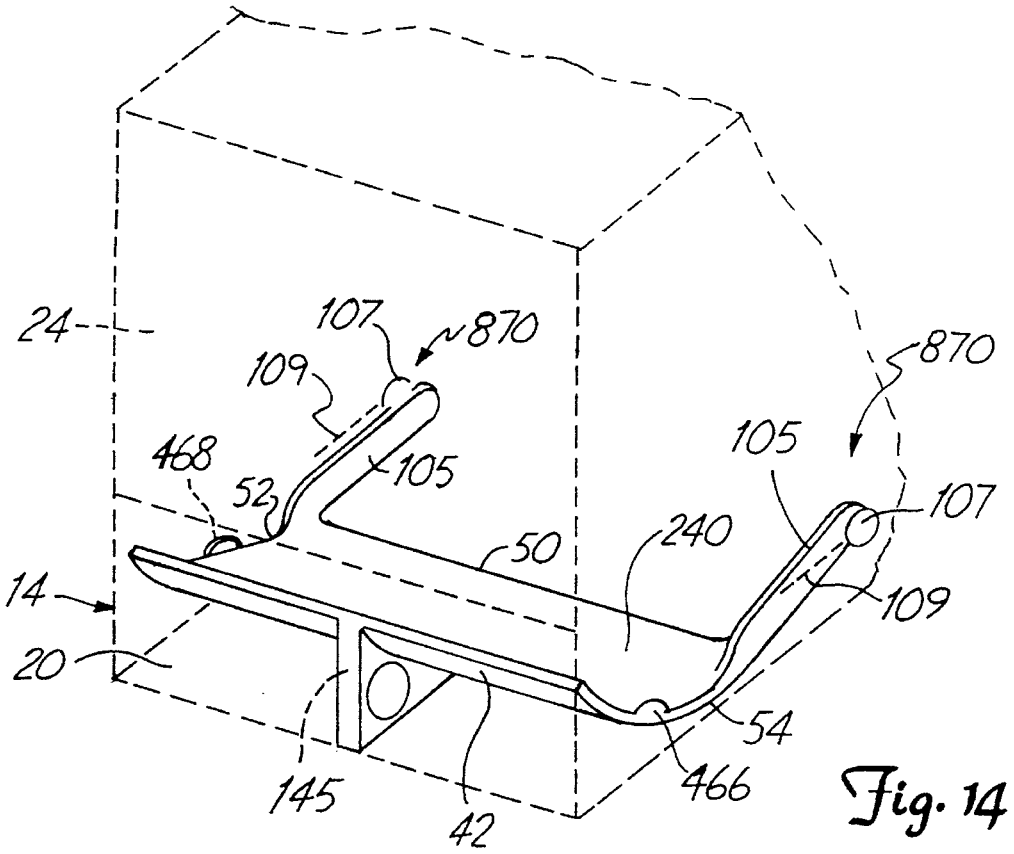
FIG. 14 is a perspective view of another embodiment of the apparatus for catching containers dispensed from a storage unit according to the present invention.

Referring to FIGS. 13 and 14 the container catcher apparatus 10 is shown packaged directly into the storage unit 16. In these arrangements the container catcher apparatus 10 is engaged with the storage unit 16 so as not to become displaced during transport of the storage unit 16. Referring to FIG. 13 the engaging member 770 includes a pair of tabs 99 protruding from the bottom surface 48 of the base member 40 and which extend substantially parallel to the bottom surface 48 of the base member 40 in a direction facing the stop member 42. Each of the tabs 99 engages a corresponding first slit 101 in the bottom wall 20 of the storage unit 16. This arrangement prohibits the container catching apparatus 10 from becoming dislodged from the storage unit 16 during transport. The tabs 99 are very similar in construction to the tab 275 shown in FIG. 7 except that the tabs 99 shown in FIG. 13 are thinner and positioned more towards the periphery of the base member 40 for stability. In order to engage the container catcher apparatus 10 to the storage unit 16 for use thereof, the container catcher apparatus 10 is first moved further inside the storage unit 16 to disengage the tabs 99 from the first slits 101. A handle 145 is provided on the stop member 42 for pulling the container catcher apparatus 10 out of the dispensing opening 14 until the tabs 99 engage a corresponding pair of second slits 103 wherein the discharge station 44 is now outside of the storage unit 16.

Referring to FIG. 14 the engaging member 870 includes a pair of arms 105 extending from the side walls 59 of the base member 40 in a direction opposite of the stop member 42. A pin 107 on each of the arms 105 engages a corresponding elongated slit 109 on the side walls 22 and 24 of the storage unit 16 such that the container carrier apparatus 10 may be pulled from the dispensing opening 14 by the consumer. The slits 109 limit the movement of the arms 105 to control the positioning of the container catcher apparatus 10.

Figure 15:
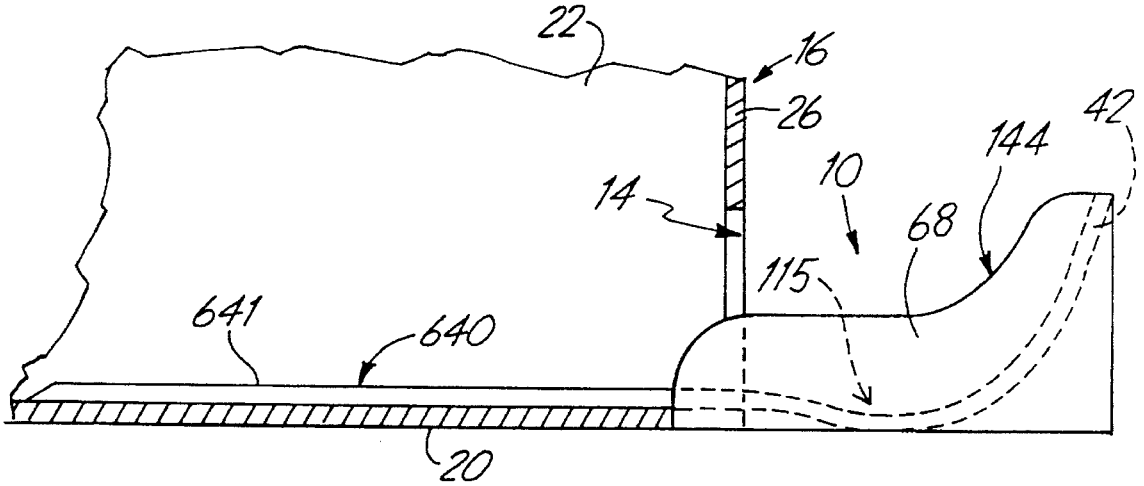
FIG. 15 is a side elevational view of the apparatus of FIG. 1 showing another embodiment of the base member.

Referring to FIG. 15 a leading portion 641 of the base member 640 is raised upward to form a recessed area 115 between the guide walls 66 and 68. The height of the raised leading portion 641 is approximately equal to the thickness of the bottom wall 20 of the storage unit 16 so that the bottom wall 20 can be inserted under the leading portion of the base member 64, thereby enabling the container catching apparatus 10 to be inserted into the opening 14 without tilting. The recessed area 115 forms the discharge station 144 and prohibits a container 12 in the discharge station 144 from rolling back into the storage unit 16. In essence, the recessed area 115 replaces the retaining ridge 60 shown in the early embodiments.

Figure 16:
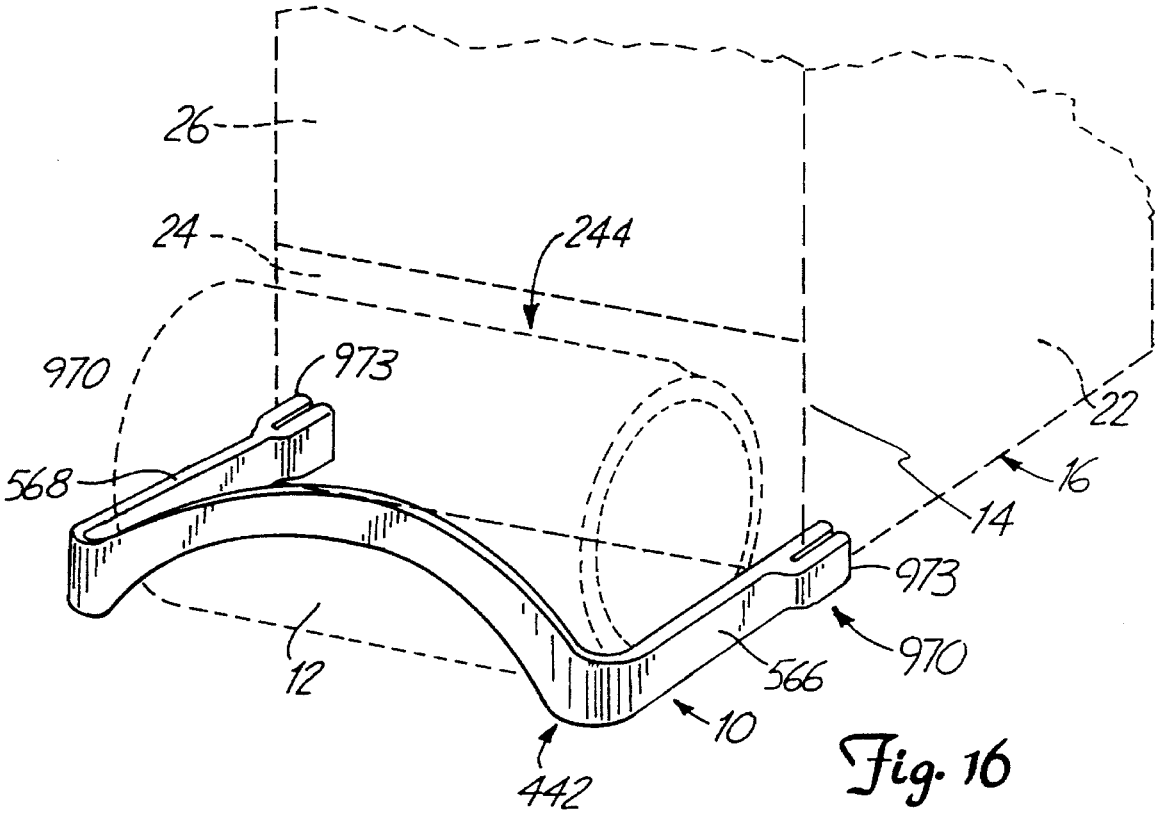
FIG. 16 is a perspective view of another embodiment of the apparatus for catching containers dispensed from a storage unit according to the present invention.

Referring to FIG. 16 there is provided a container catcher apparatus 10 having guide walls 566 and 568, a stop member 442, and engaging members 970 for securing the guide walls 566 and 568 to the side walls 22 and 24 of the storage unit 16. The guide walls 566 and 568 are in the form of arms spaced apart from each other a sufficient distance to receiver the container 12 from the dispensing opening 14. The engaging members 970 are mounted to an inner end of each arm. The engaging members 970 include pinch point extensions 973 biased towards each other for engaging the side walls 22 and 24. The stop member 442 is shown as an elongated member integrally formed between outer ends of the guide walls 566 and 568. Although the stop member is shown bowed inward towards the dispensing opening 14, the stop member 442 may be perpendicular to the guide walls 556 and 568 or bowed outward, upward or downward. The discharge station 244 is formed between the guide walls 566 and 568 and the stop member 442 for receiving containers 12 from the dispensing opening 14. Although a base member is not shown in this embodiment, it is within the intended scope of the invention that one may be present.

Referring again to FIG. 1 the container catching apparatus 10 is shown in use with a container 12 in the discharge station 44. If the container catching apparatus 10 is manufactured, packaged and sold separate and distinct from the storage unit 16, then the consumer must remove the perforated panel to expose the dispensing opening 14. The container catching apparatus 10 is then mounted adjacent to the dispensing opening 14 in one of the ways discussed above depending on the type of engaging member 70 and if one is present. The container catching apparatus may also be packaged and sold with the storage unit 16. In such an arrangement the container catching apparatus 10 shown in FIGS. 2–12 may attached to the exterior of the storage unit 16 using a plastic wrap. Alternatively the container catcher apparatus 10 shown in FIGS. 2–14 may be positioned in the interior of the storage unit 16.

In sum, the present invention provides an apparatus for catching containers 12 dispensed from a storage unit 16. The apparatus includes a stop member and a base member or other means for the stop member to communicate with the storage unit 16, and preferably, but not necessarily an engaging member. Several embodiments of these elements have been shown in FIGS. 2–14. However, although the present invention has been described with reference to these preferred embodiments, workers skilled in the art will recognize that additional changes may be made in form and detail without departing from the spirit and scope of the invention.

What is claimed is:

1. An apparatus for catching containers dispensed from an opening of a portable storage unit formed by opposed side walls, the storage unit having a plurality of said containers for the transport and storage of said containers therein, the storage unit being positionable such that each of the plurality of containers exits the storage unit one at time through the opening, the apparatus comprising:

a base member having a raised leading portion running parallel to a bottom wall of the storage unit and permitting the bottom wall of the storage unit to be inserted thereunder, the base member extending outward from the bottom wall of the storage unit such that a discharge station is defined adjacent the opening for receiving and dispensing each of the plurality of containers, the base member having a recessed area in the discharge station for preventing a container in the discharge station from rolling back into the storage unit, the recessed area having a depth equal to at least approximately the thickness of the bottom wall of the storage unit;

stop means attached to the base member for retaining each of the plurality of containers in the discharge station such that the plurality of containers remaining within the storage unit are retained therein, such that when one of the containers is removed from the discharge station one of the plurality of containers remaining in the storage unit is forced into the discharge station and retained thereon by the stop means; and engaging means operable with the base member for engaging the apparatus to opposed side walls of the storage unit.

2. The apparatus of claim 1, wherein the engaging means includes an engaging member extending outward from a periphery of the base member, the engaging member having a portion spaced apart from the base member such that each of the opposed side walls of the storage unit adjacent the opening is engaged between the periphery of the base member and the spaced-apart portion of the engaging member.

3. The apparatus of claim 2, wherein the spaced apart portion of the engaging member and a corresponding periphery section of the base member includes gripping teeth for engaging each of the side walls of the storage unit.

4. The apparatus of claim 2, wherein the spaced apart portion of the engaging member and the corresponding periphery section of the base member includes a pin and recess structure for engaging each of the side walls of the storage unit.

5. The apparatus of claim 1, wherein the apparatus further comprises a guide member mounted to a periphery of the base member for guiding each container from the opening to the discharge station.

6. The apparatus of claim 5, wherein the guide member is a wall extending between the base member and the stop means.

7. The apparatus of claim 5, wherein the stop means is a elongated member mounted between guide members which are positioned on opposite sides of the base member thereby forming the trailing edge of the discharge station.

8. The apparatus of claim 1, wherein the apparatus further comprises a retaining ridge protruding upward from the base member at a trailing edge of the discharge station opposite of the stop means for preventing a container in the discharge station from rolling back into the storage unit.

9. An apparatus for catching containers dispensed from an opening of a storage unit formed between opposed side walls thereof, a bottom wall thereof and a front wall thereof, the storage unit being positionable such that each of a plurality of containers within the storage unit exits the storage unit one at time through the opening, the apparatus comprising:

a discharge station defined outside the storage unit, adjacent the opening for sequentially receiving and dispensing each of the plurality of containers therefrom; and a stop member for retaining each of the plurality of containers in the discharge station such that the plurality of containers remaining within the storage unit are retained therein, such that when one of the containers is removed from the discharge station one of the plurality of containers remaining in the storage unit is forced into the discharge station and retained thereon by the stop member; and engaging member for engaging the stop member to the opposed sidewalls of the storage unit, the engaging member extending outward from a periphery of the stop member and including thereon a spaced-apart portion such that a respective one of the pair of opposed side walls of the storage unit adjacent the opening is engaged in the respective spaced-apart portion of the engaging member, and wherein the spaced-apart portions of the engaging member each includes gripping teeth for engaging a respective side walls of the storage unit.

10. The apparatus of claim 9, wherein the discharge station has a recessed area for preventing a container in the discharge station from rolling back into the storage unit, the recessed area having a depth equal to at least approximately the thickness of the bottom wall of the storage unit.

11. The apparatus of claim 9, wherein the stop member is U-shaped including a pair of opposed guide walls, the engaging member including a pinch point area at the ends of the guide walls for engaging the stop member to the storage unit.

12. The apparatus of claim 9, further comprising a base member having a raised leading portion running parallel to the bottom wall of the storage unit and permitting the bottom wall of the storage unit to be inserted thereunder, the base member extending outward from the bottom wall of the storage unit to further define the discharge station between the opening and the stop member for receiving and dispensing each of the plurality of containers, and the base member in combination with the engaging member defining the spaced-apart portions.

13. An apparatus for catching containers dispensed from an opening of a portable storage unit formed by opposed side walls, storage unit having a plurality of said containers for the transport and storage of said containers therein, the storage unit being positionable such that each of the plurality of containers exits the storage unit one at a time through the opening, the apparatus comprising:

a base member having a raised leading portion running parallel to a bottom wall of the storage unit and permitting the bottom wall of the storage unit to be inserted thereunder, the base member extending outward from the bottom wall of the storage unit such that a discharge station is defined adjacent the opening for receiving and dispensing each of the plurality of containers, the base member having a recessed area in the discharge station for preventing a container in the discharge station from rolling back into the storage unit, wherein the depth of the recessed area is equal to at least approximately the thickness of the bottom wall of the storage unit;

stop means attached to the base of the member for retaining each of the plurality of containers in the discharge station such that a plurality of containers remaining within the storage unit are retained therein, such that when one of the containers is removed from the discharge station one of the plurality of containers remaining in the storage unit is forced into the discharge station and retained thereon by the stop means.

14. The apparatus of claim 13, further comprising an engaging member extending outward from a periphery of the base member, the engaging member having a portion spaced-apart from the base member such that each of the opposed side walls of the storage unit adjacent the opening is engaged between the periphery of the base member and the spaced-apart portion of the engaging member.

15. The apparatus of claim 14, further comprising gripping teeth in the spaced-apart portion of the engaging member for gripping the side wall of the storage unit.

16. An apparatus for catching containers dispensed from an opening of a storage unit formed between opposed side walls thereof, a bottom wall thereof and a front wall thereof, the storage unit being positionable such that each of a plurality of containers within the storage unit exits the storage unit one at time through the opening, the apparatus comprising:

a discharge station defined outside the storage unit, adjacent the opening for sequentially receiving and dispensing each of the plurality of containers therefrom;

a stop member for retaining each of the plurality of containers in the discharge station such that the plurality of containers remaining within the storage unit are retained therein, such that when one of the containers is removed from the discharge station one of the plurality of containers remaining in the storage unit is forced into the discharge station and retained thereon by the stop member; and engaging member for engaging the stop member to the opposed sidewalls of the storage unit, the engaging member extending outward from a periphery of the stop member and including thereon a spaced-apart portion such that a respective one of the pair of opposed side walls of the storage unit adjacent the opening is engaged in the respective spaced-apart portion of the engaging member, and wherein the spaced-apart portions of the engaging member each includes a pin and recess structure for engaging each of the side walls of the storage unit.

17. The apparatus of claim 16, wherein the discharge station has a recessed area for preventing a container in the discharge station from rolling back into the storage unit, the recessed area having a depth equal to at least approximately the thickness of the bottom wall of the storage unit.

18. The apparatus of claim 16, wherein the stop member is U-shaped including a pair of opposed guide walls, the engaging member including a pinch point area at the ends of the guide walls for engaging the stop member to the storage unit.

19. The apparatus of claim 16, further comprising a base member having a raised leading portion running parallel to the bottom wall of the storage unit and permitting the bottom wall of the storage unit to be inserted thereunder, the base member extending outward from the bottom wall of the storage unit to further define the discharge station between the opening and the stop member for receiving and dispensing each of the plurality of containers, and the base member in combination with the engaging member defining the spaced-apart portions.

* * * * *